US005609505A

United States Patent [19]

Endo et al.

[11] Patent Number: 5,609,505

[45] Date of Patent: Mar. 11, 1997

[54] TERMINAL AND METHOD OF MANUFACTURING SAME

[75] Inventors: Takayoshi Endo; Naoto Sugie, both of Shizuoka, Japan

[73] Assignee: Yazaki Corporation, Tokyo, Japan

[21] Appl. No.: 435,665

[22] Filed: May 5, 1995

[30] Foreign Application Priority Data

May 17, 1994 [JP] Japan ..... 6-102716

[51] Int. Cl.[6] ..... H01R 9/24

[52] U.S. Cl. ..... 439/886; 439/936

[58] Field of Search ..... 439/884, 886, 439/936, 825, 699.1

[56] References Cited

U.S. PATENT DOCUMENTS

| | | | |
|---|---|---|---|
| 3,553,628 | 1/1971 | Crimmins | 439/699.1 X |
| 3,853,377 | 12/1974 | Shlesinger | 439/825 X |
| 4,981,450 | 1/1991 | Salvatore | 439/886 X |
| 5,193,271 | 3/1993 | Kato | 29/885 |

*Primary Examiner*—P. Austin Bradley
*Assistant Examiner*—Daniel Wittels
*Attorney, Agent, or Firm*—Sughrue, Mion, Zinn, Macpeak & Seas

[57] ABSTRACT

A terminal, and methods for manufacturing the terminal, in which the opening defined by the electric contact portion is filled with a material. As a result, plating solutions will not become entrapped in the opening so that corrosion of the terminal will be prevented. The terminal includes an electrically conductive plate including a wire connecting portion for clamping a wire thereto and an electric contact portion for mating with another terminal, the contact portion including a cavity therein; and a filler material disposed in the cavity. As a result, when the terminal is subjected to metal plating, solutions associated with the metal plating are substantially prevented from entering into the cavity. According to one method, the filler material is first adhered to the conductive plate before the plate is bent into the shape of the terminal. According to a second method, the filler material is injected into the cavity of the contact portion after the terminal has been bent.

3 Claims, 3 Drawing Sheets

TERMINAL AND METHOD OF MANUFACTURING SAME

BACKGROUND OF THE INVENTION

1. Field of the Invention

This invention relates to a terminal and a method of manufacturing a terminal which is used for connecting electric circuits.

2. Background

A pair of terminals including a male terminal and a female terminal are generally used for interconnecting electric circuits. FIG. 5 is a perspective view of an example of a male terminal M.

The male terminal M is formed by bending an electric conductive plate. Specifically, an electric contact portion a located at an end portion of the male terminal M is formed by bending the electric conductive plate inwardly. The electric contact portion a is received in a cylindrically or cubically shaped opening of the female terminal (not shown), and is electrically engaged by a spring member provided in the electric contact portion of the female terminal.

Conventionally, the contact surface of the electric contact portion of the terminal is metal-plated with a different type of a metal from the base material to prevent corrosion and improve electrical conduction, etc. An example of a method conventional metal-plating is disclosed in Japanese Patent Laid-Open No. Hei. 5-6790. In this method, a conductive plate is first plated and then bent into the shape of a male terminal by a punching or a pressing process. Further, according to another example, it is well-known to form the male terminal and then dip the male terminal into a plating liquid.

However, in the former method, when an electric contact portion of the male terminal is formed by pressing the conductive plate after it has been plated, there is a possibility that cracks may form in the plated surface of the electric contact portion. Thus, the reliability of the terminal is poor since cracks may develop along with corrosion. Furthermore, there is a fault that vain plating liquids are needed, because a metal-plated portion naturally remains on a scrap of the electric conductive plate after punching the male terminal.

On the other hand, in the latter method, the electric contact portion a of a male terminal M (shown in FIG. 5) is formed by a pressing operation in which the metal plate is inwardly folded resulting in the hardening of the electric contact portion a. However, with reference to FIG. 6, the plating liquid may become entrapped in the opening b as a result of being dipped in the liquid.

Namely, a preliminary treatment process (a grease-removing treatment ⇒ a washing treatment ⇒ an activating treatment ⇒ the washing treatment ⇒ the activating treatment ⇒ the washing treatment and a pure-watering treatment) is done before a metal-plating treatment process, the male terminal M is metal-plated using a variety of solutions (e.g., an alkaline cleaner used in the grease-removing treatment, a dilute sulfuric acid used in the activating treatment and etc.) associated with the preliminary treatment process. The solutions (or a treatment solution of the metal-plating treatment process) may become entrapped in the opening b thereby gradually corroding the metal-plated layer or the base material (copper etc.) of the terminal.

SUMMARY OF THE INVENTION

The present invention has been made in order to overcome the above problems and drawbacks, and an object of the invention is to prevent corrosion by providing a filler material in the opening portion of the terminal so that the treatment solutions do not enter into the opening portion. Moreover, the object of the invention is to provide terminals having greater reliability and durability.

The above object has been achieved by a terminal characterized in that, a filler material fills the opening formed in the portion of an electric conductive plate forming the terminal. Furthermore, it is desirable to metal-plate the terminal.

Further, according to the present invention, a method of manufacturing a terminal comprises the step of: adhering a filler material at a bending position of an electric contact portion of an electric conductive plate; and, thereafter, bending the electric conductive plate so as to surround the filler material.

Furthermore, according to the present invention, an alternative method of manufacturing a terminal comprises the step of: first forming the terminal and, thereafter, injecting a filler material in the opening of a bending portion of an electric contact portion of the terminal.

The terminal formed according to the present invention, does not experience corrosion as a result of being dipped in the plating solution, because the solution is not able to enter into the opening portion due to the presence of the filler material therein. As a result, the terminal is more reliable and durable.

DETAILED DESCRIPTION OF THE PREFERRED EMBODIMENTS

Figure 1:
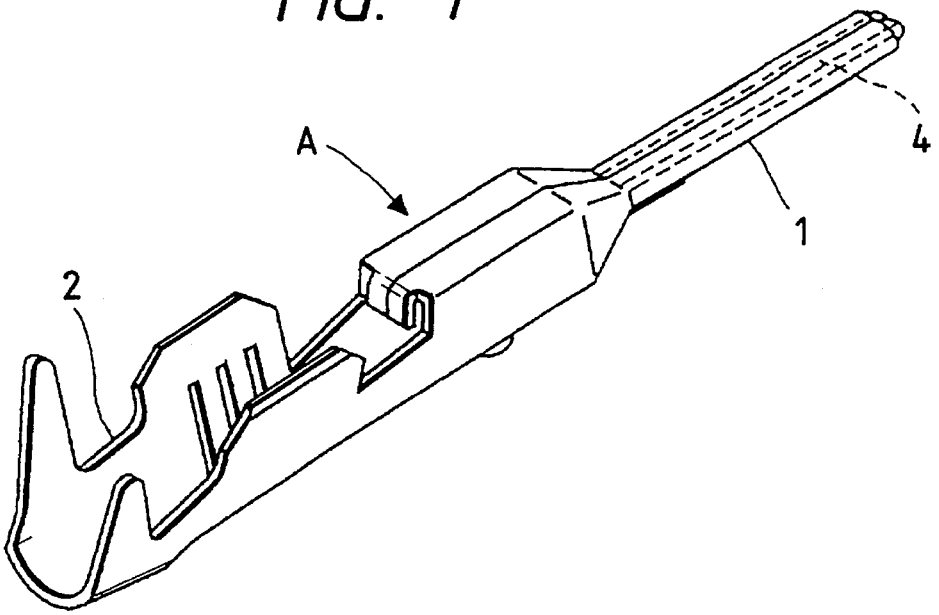
FIG. 1 is a perspective view of a terminal of a preferred embodiment of the present invention.
Figure 2:
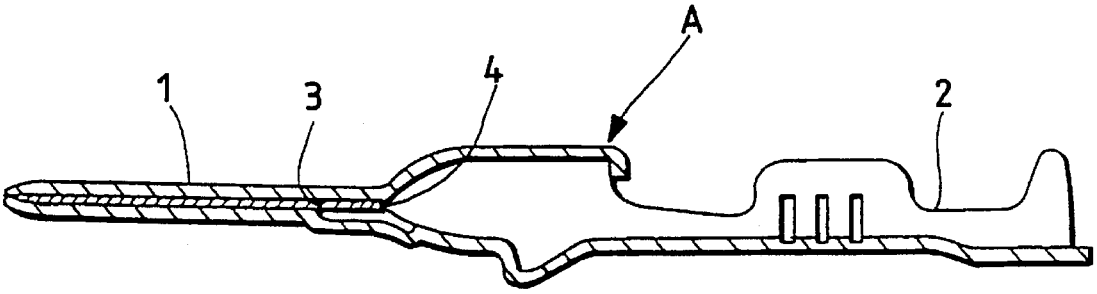
FIG. 2 is a vertical cross-sectional view of the terminal of FIG. 1.

FIG. 1 is a perspective view of a terminal A of one preferred embodiment of the present invention, FIG. 2 is a vertical cross-sectional view of the terminal of FIG. 1.

The terminal A is a male terminal formed by bending an electric conductive plate. The male terminal includes an electric contact portion 1 at one end thereof, and a wire connecting portion 2 formed at the other end thereof.

An inner side of the electric contact portion 1 has an opening 3 formed by bending the electric conductive plate in a pressing process. According to the invention, the opening 3 is filled with a filler material 4 so that a plating solution will not enter into the opening 3.

A method of manufacturing the terminal A will be described next.

Figure 3:
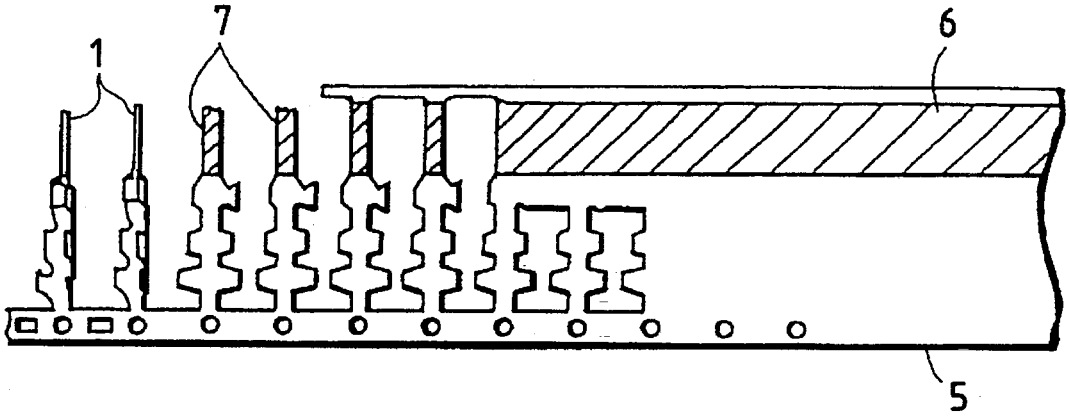
FIG. 3 is a plan view illustrating various steps in a process of manufacturing the terminal of FIG. 1.

First, as shown in FIG. 3, an adhesive tape 6 constituting the filler material, is continuously pasted on a horizontal surface of the electric conductive plate 5, beforehand. The adhesive tape 6 is located at a position corresponding to the electric contact portion 1 of the terminal A formed by bending the electric conductive plate 5.

The terminal A is successively formed by punching and bending the electric conductive plate 5. In the bending operation, the portion 7 is bent so that the metal plate substantially surrounds the adhesive tape 6 thereby forming the electric contact portion 1. As a result, the opening 3 is completely filled by the adhesive tape 6. The terminal A is then metal-plated to form the terminal A without any of the plating liquid becoming entrapped in the opening 3.

In the above described process, the adhesive tape 6 is a polyester series tape, but it is possible to use both an insulative material and an electrically conductive material.

Specifically, the filler material may include a rubber material, coating chemicals or a metal material which is the same as or different from the base plate of a terminal. However, it is desirable that the filler material be able to maintain a solid (or a gel) condition at a temperature range from room temperature (approximately 20° C.) to 70° C., corresponding to the temperature range of the plating.

In the metal-plating process, the various solutions are unable to enter into the opening 3 of the electric contact portion 1 due to the presence of the tape 6 so that corrosion of the terminal A does not occur.

Figure 4:
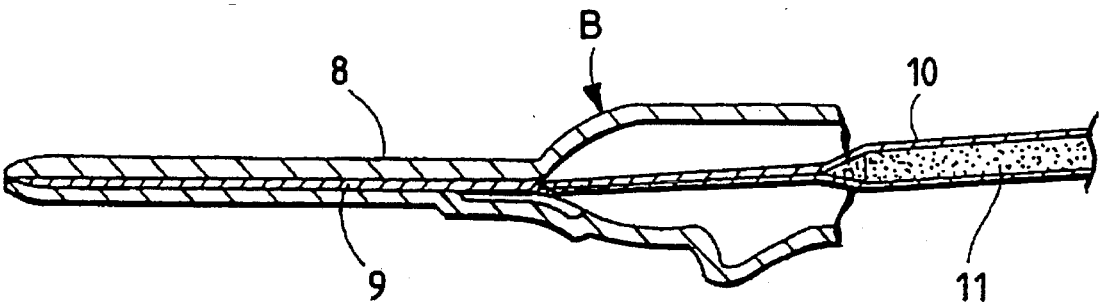
FIG. 4 is a vertical cross-sectional view of a terminal manufactured using another process.
Figure 5:
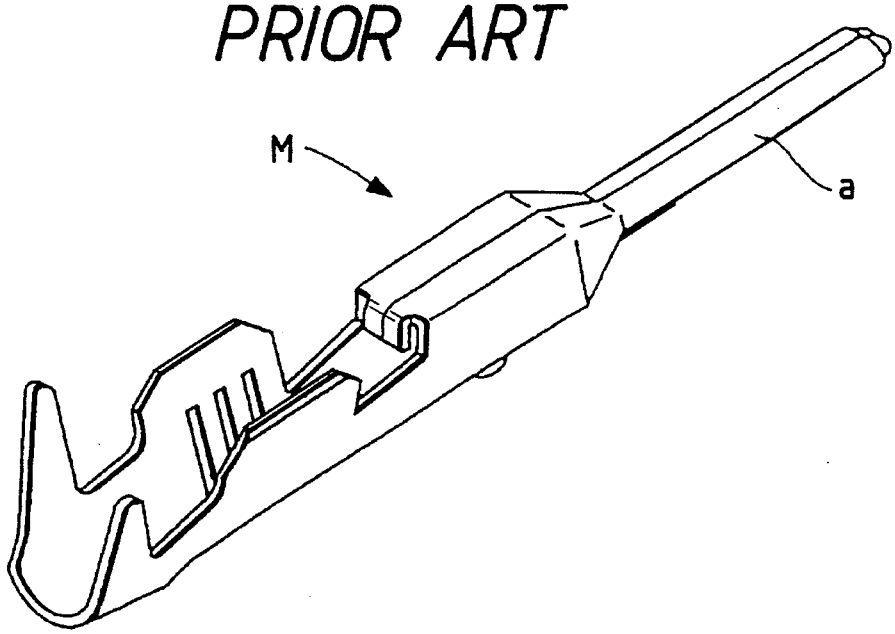
FIG. 5 PRIOR ART
FIG. 5 is a perspective view of a conventional male terminal.
Figure 6:
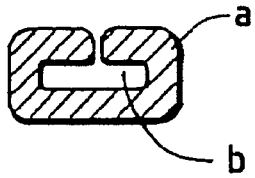
FIG. 6 PRIOR ART
FIG. 6 is a cross-sectional view of an electric contact portion of the male terminal of FIG. 5.
Figure 7:
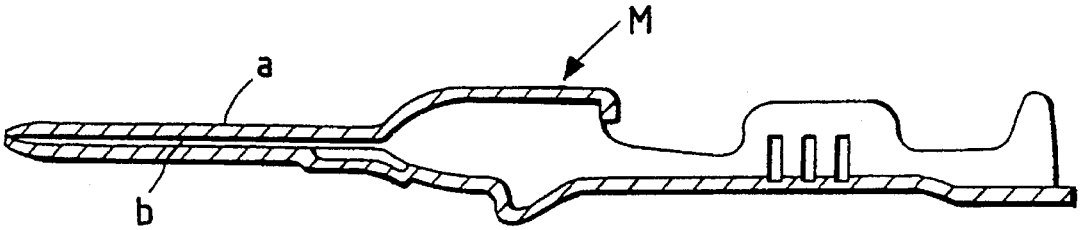
FIG. 7 PRIOR ART
FIG. 7 is a vertical cross-sectional view of the male terminal of FIG. 5.

A second process will now be described with reference to FIG. 4. According to this process, an epoxy resin 11 is used as the filler material and is injected into an opening 9 of an electric contact portion 8 of a previously formed terminal B by using a syringe 10. The filler material is in a liquid state when it is injected and is then converted to a solid so that plating liquids are prevented from entering into the opening 9. This process can be used to fill voids in various types of terminals.

As can be seen from the foregoing, the present invention is directed to a terminal, and methods for manufacturing the terminal, in which the opening defined by the electric contact portion is filled with a material. As a result, plating solutions will not become entrapped in the opening so that corrosion of the terminal will be prevented.

What is claimed is:

1. A terminal, comprising:

an electrically conductive plate including a wire connecting portion for clamping a wire thereto and an electric contact portion for mating with another terminal, said contact portion including a cavity therein; and a filler material disposed in said cavity, wherein when said terminal is subjected to a metal plating, solutions associated with said metal plating are substantially prevented from entering into said cavity.

2. The terminal of claim 1, wherein said filler material includes an adhesive tape.

3. The terminal of claim 1, wherein said filler material is in a gel state at a temperature range in a metal plating treatment.

* * * * *